US008820716B1

(12) United States Patent
Silver

(10) Patent No.: US 8,820,716 B1
(45) Date of Patent: Sep. 2, 2014

(54) CORD TIGHTENING TOOL

(71) Applicant: Christopher A. Silver, Marshville (CA)

(72) Inventor: Christopher A. Silver, Marshville (CA)

( * ) Notice: Subject to any disclaimer, the term of this patent is extended or adjusted under 35 U.S.C. 154(b) by 0 days.

(21) Appl. No.: 13/759,238

(22) Filed: Feb. 5, 2013

(51) Int. Cl.
*B21F 9/00* (2006.01)
*B66F 3/00* (2006.01)
*E04H 17/06* (2006.01)

(52) U.S. Cl.
CPC ..... *E04H 17/06* (2013.01)
USPC ..... 254/231; 256/37

(58) Field of Classification Search
USPC ..... 254/231, 232, 233, 234, 243, 251; 256/37, 40, 44
See application file for complete search history.

(56) References Cited

U.S. PATENT DOCUMENTS

| | | | | |
|---|---|---|---|---|
| 397,635 | A | 2/1889 | Flatau | |
| 591,495 | A | 10/1897 | Probasco | |
| 606,737 | A | 7/1898 | Probasco | |
| 656,622 | A | 8/1900 | Barnes | |
| 763,445 | A | 6/1904 | Vogelzang | |
| 805,764 | A | 11/1905 | Wheelock et al. | |
| 1,159,906 | A | 11/1915 | Dewees | |
| 1,484,558 | A * | 2/1924 | Peto | 72/390.6 |
| 1,638,432 | A * | 8/1927 | Connors | 254/231 |
| 1,957,367 | A * | 5/1934 | Suydam | 188/196 M |
| 2,344,052 | A * | 3/1944 | Neale | 24/71.1 |
| 2,484,957 | A | 10/1949 | Parks | |
| 2,564,541 | A | 8/1951 | Mallory | |
| 2,654,796 | A * | 10/1953 | Hubbard | 254/232 |
| D265,171 | S * | 6/1982 | Zukaitis | D8/44 |
| 5,623,751 | A * | 4/1997 | Knutson | 24/71.1 |
| 5,911,409 | A * | 6/1999 | Grover | 254/235 |
| 7,386,920 | B2 * | 6/2008 | De Meo | 24/71.1 |
| 7,451,962 | B1 * | 11/2008 | Kennedy | 254/233 |
| D657,645 | S * | 4/2012 | Scott | D8/51 |
| 2005/0133771 | A1 * | 6/2005 | Kohler | 254/232 |
| 2008/0011995 | A1 | 1/2008 | Ross et al. | |

* cited by examiner

*Primary Examiner* — Emmanuel M Marcelo
(74) *Attorney, Agent, or Firm* — Robert C Montgomery; Montgomery Patent & Design

(57) ABSTRACT

A cord tightening tool used to tighten elongated flexible cord includes a frame with each outer end having a saddle that attaches to a cord to be tightened. A hook with a swivel mount is provided in a center of the frame that attaches to the cord between the saddles. A threaded shaft connected to the hook can be rotated to pull the cord downward to remove slack. The saddles and hook are interchangeable with different shapes to be used with various types of cord materials.

20 Claims, 4 Drawing Sheets

CORD TIGHTENING TOOL

RELATED APPLICATIONS

Not applicable.

FIELD OF THE INVENTION

The present invention relates generally to fencing tools, and in particular, to tool for adjustably tightening a cord material, such as fencing.

BACKGROUND OF THE INVENTION

Domesticated animals on farms and ranches across the country have been contained by wire fences for years. This type of fencing, supplied in rolls, is attached to upright posts using fasteners. This fencing is relatively cheap, easy to install and works fairly effectively in containing animals such as horses, cattle, sheep, goats, and the like. Other variations such as barbed wire fences, electrified fences, and the like also use wire rails in a similar configuration. During maintenance of such fences, it is often necessary to tighten the wire as it is prone to stretching over time. Additionally, such tightening often needs to be relieved during cold weather to prevent breakage of overstressed wires. This adjustment process is often accomplished with fence pliers, screwdrivers, or similar tools, but with limited success as the tightening process often results in wire breakage.

Accordingly, there exists a need for a means by which wire components on fencing can be easily tightened and loosened without the disadvantages as described above. Therefore, despite any advances already in the field, those skilled in the art continue with research and development efforts directed to adjusting the tension of installed cord materials.

SUMMARY OF THE INVENTION

The inventor has recognized the aforementioned inherent problems and lack in the art and observed that there is a need for an apparatus and method that easily and quickly adjusts the tension of installed cord materials, such as fencing. The development of the present invention, which will be described in greater detail herein, substantially departs from conventional solutions to provide cord tightening tool and in doing so fulfills this need.

In one embodiment, the disclosed cord tightening tool can include a frame having opposing ends, a pair of saddles attached to the opposing ends, and a hook assembly adjustably attached to the frame between the opposing ends.

In another embodiment, the disclosed cord tightening tool can include a curved frame having a first end and a laterally opposed second end, a first saddle pivotably attached to the frame first end, a second saddle pivotably attached to the frame second end, a drive shaft having a lower end adjustably attached to the frame between the first end and the second end and an upper end, a swivel mount rigidly attached to the drive shaft upper end, and, a hook rotatably attached to the swivel mount.

Furthermore, the described features and advantages of the disclosed cord tightening tool can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
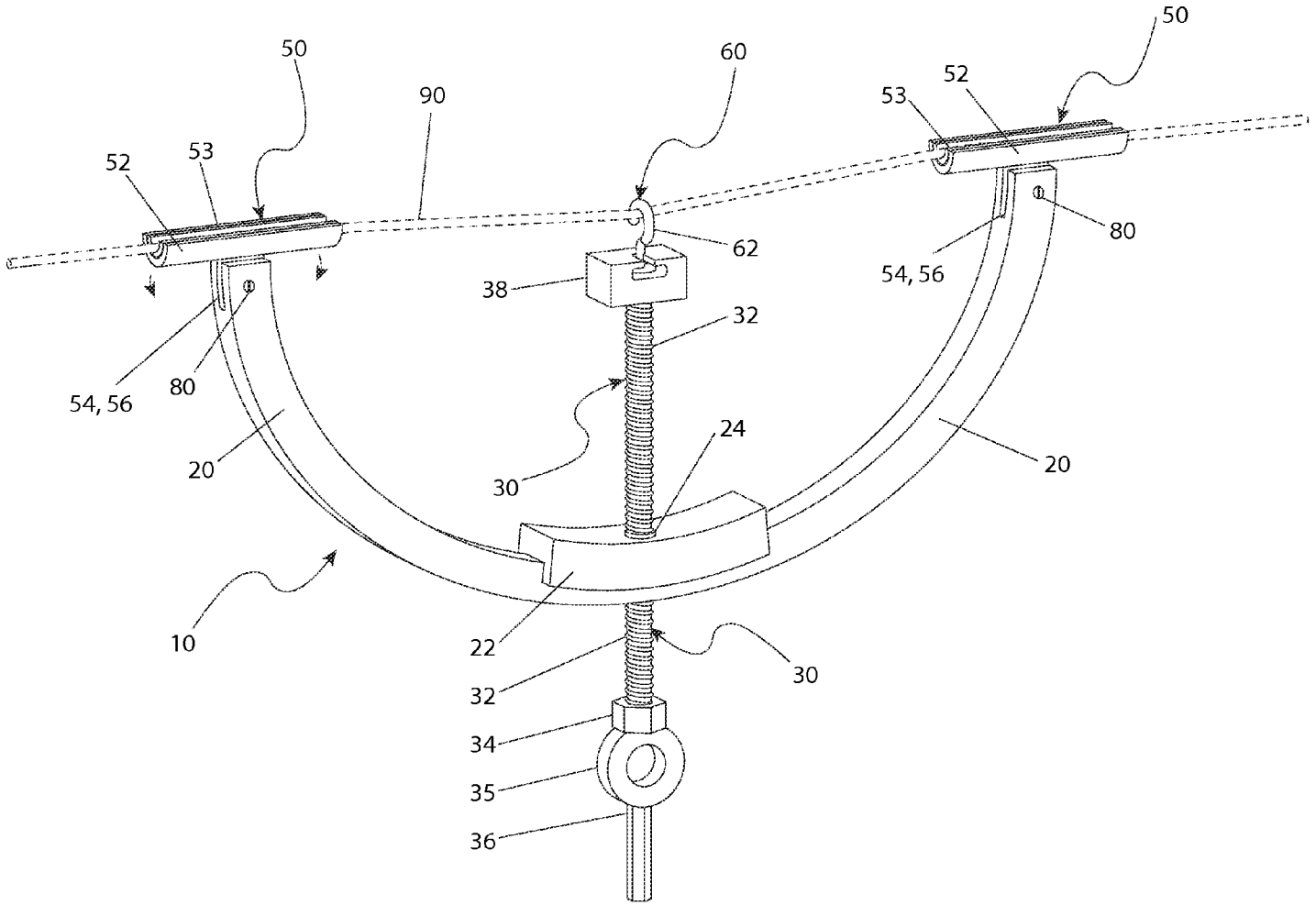
FIG. 1 is a front perspective view of a cord tightening tool in accordance with the present invention.

10 cord tightening tool
20 frame
22 drive block
24 threaded insert
26 upper end
28 fastener aperture
30 drive shaft assembly
32 threaded shaft
34 hex nut drive
35 thumb screw feature
36 hex rod drive
38 swivel mount
39 first slot
40 second slot
50 round saddle assembly
52 round saddle
53 round saddle liner
54 frame mount
56 slot
60 round hook assembly
62 round cord hook
64 base
66 round hook liner
80 threaded fastener
82 nut fastener
90 round cord
92 flat cord
100 flat cord embodiment
150 flat saddle assembly
152 flat saddle
153 flat saddle liner
160 flat hook assembly
162 flat hook
166 flat hook liner

DETAILED DESCRIPTION OF THE PREFERRED EMBODIMENT

In accordance with the invention, the best mode is presented in terms of the described embodiments, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 4, disclosing a cord tightening tool (herein generally described as an "apparatus") 10, where like reference numerals represent similar or like parts. In accordance with the invention, the present disclosure describes an apparatus 10 used to tighten various cord material 90.

Referring first to FIG. 1, the apparatus 10 generally includes a bow-shaped frame 20 with an interchangeable saddle 50 and hook 60 that can be attached to a cord 90 to force an elongated angled section and remove slack in the cord 90. The interchangeable saddle 50 and hook 60 allow the apparatus 10 to be used with different cord shapes, such as cables, wires, ropes, straps, and the like. The use of the apparatus 10 allows workers to remove sagging portions of wire fence rails, guy lines, ropes, tie-downs, strapping, or cord structures.

The apparatus 10 can generally include a "C"-shaped or semi-circular frame 20. The frame 20 can be approximately four to ten inches (4-10 in.) across based upon a particular application. The apparatus 10 is illustrated being configured for use with a round cord 90; however, the apparatus 10 provides interchangeable structural features for use with various shapes and sizes of cord material (see FIG. 4).

The frame 20 can preferably be made using hollow square aluminum tubing or equivalent strong light-weight material. Each upwardly extending and opposing upper end 26 of the frame 20 provides for attachment to a respective round saddle assembly 50. The saddle assembly 50 can include a horizontal half-cylinder-shaped appendage which receivably supports a length of the round cord 90 to be shortened (see FIG. 3).

The frame 20 further provides for attachment of a central vertical assembly having a round hook assembly 60 and a drive shaft assembly 30 which in use, attaches to and pulls down on the round cord 90 at a half way point between the aforementioned round saddle assemblies 50 to remove any slack. The round hook assembly 60 and the drive shaft assembly 30 are joined together by a swivel mount 38. The frame 20 also includes an integral drive block 22 located at a lower intermediate position. The drive block 22 includes a centrally-located threaded insert 24 being inserted into and through a center portion of the drive block 22 by a press fit. The threaded insert 24 provides threaded attachment to a threaded shaft 32 of the drive shaft assembly 30. Both the threaded insert 24 and the threaded shaft 32 include matching fine threads which allow sufficient vertical adjustment of the round hook assembly 60 while preventing unintended rotation.

The swivel mount 38 can be removably attached to the round hook assembly 60 in a freely-rotating manner allowing the drive shaft assembly 30 to rotate while the round hook assembly 60 remains stationary and connected to the round cord 90. The drive shaft assembly 30 and round hook assembly 60 allow the round cord 90 to be pulled in a downward, linear direction in a controlled manner, thus producing tension in the round cord 90 (see FIG. 2).

A desired amount of slack in the round cord 90 can be removed as a portion of the cord 90 is forced out of alignment as the round saddle assemblies 50 support the end portions of a set length of the round cord 90, and the centrally attached round hook assembly 60 pulls downwardly on the round cord 90.

As the drive shaft assembly 30 is rotated, it acts to lower or raise the round hook assembly 60 being attached to the round cord 90. The threaded shaft 32 of the drive shaft assembly 30 can engage the threaded insert 24 and can include integral portions which enable rotary adjustment of the threaded shaft 32 including a hex nut drive 34 for adjustment using a wrench, a thumbscrew feature 35 for manual adjustment, and a hex rod drive 36 for attachment of a drill or similar motorized tools. The adjusting portions 34, 35, 36 can be arranged in a linear manner at a bottom portion of the threaded shaft 32 and provide a plurality of adjustment methods. Additionally, the thumbscrew feature 35 can also include a central aperture to enable rotation of the drive shaft assembly 30 by insertion of a screwdriver or similar tool.

Figure 2:
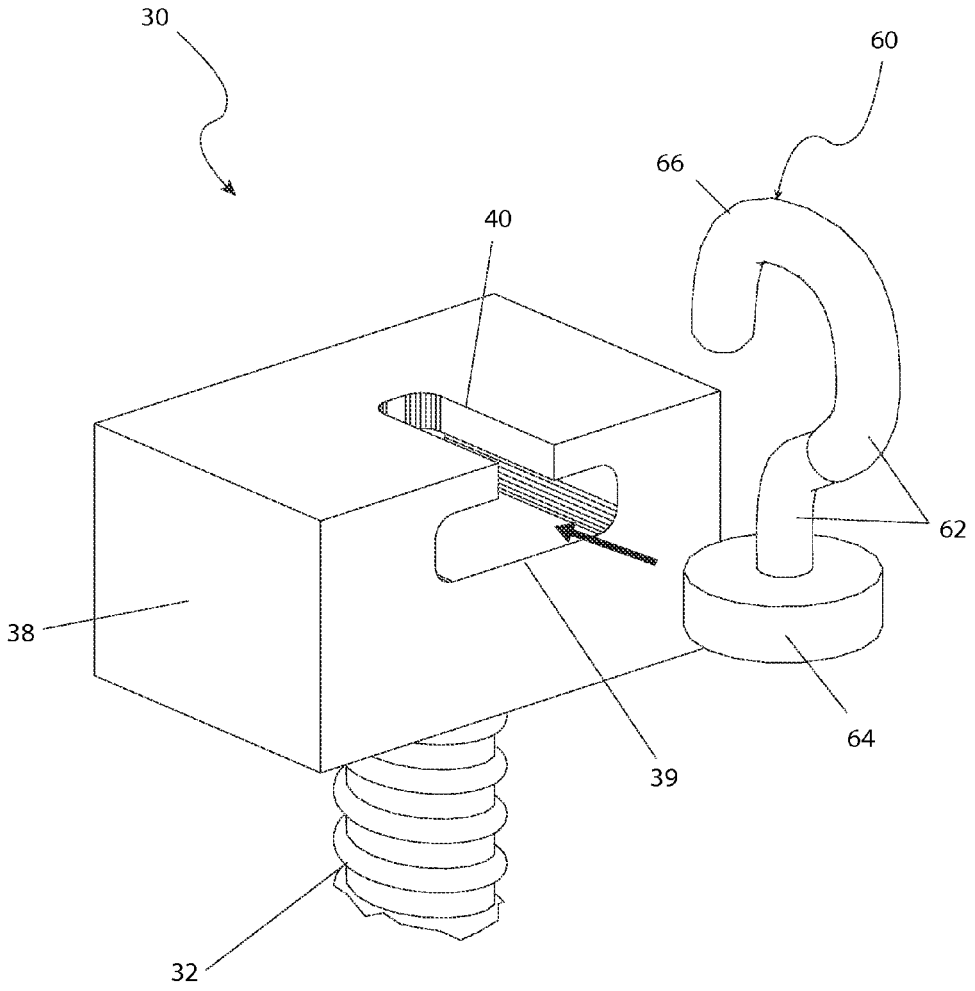
FIG. 2 is a close-up view of drive shaft and hook of the disclosed cord tightening tool.
Figure 3:
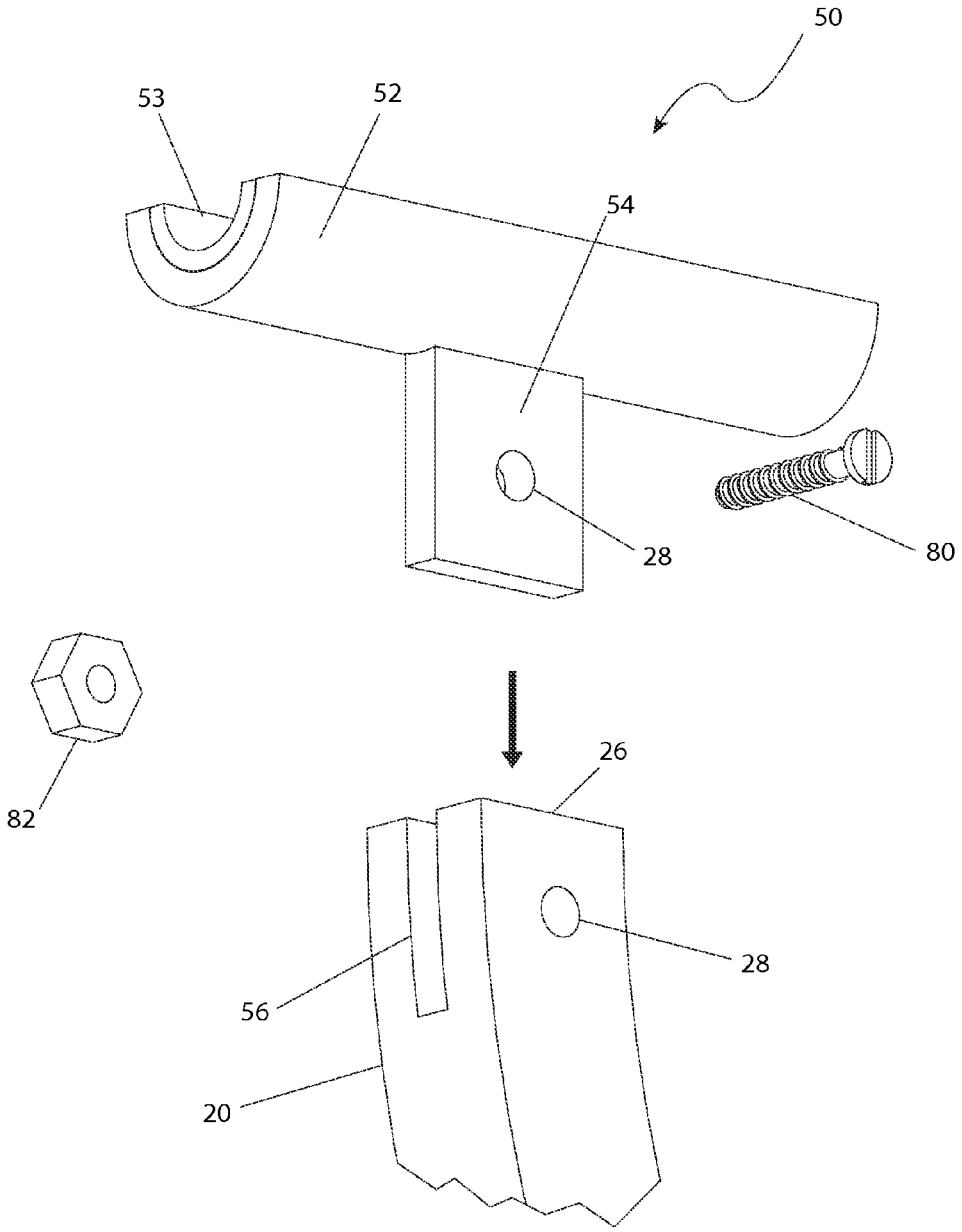
FIG. 3 is a close-up view of a saddle assembly of the disclosed cord tightening tool; and, FIG. 4 is a front perspective view of another embodiment of the disclosed cord tightening tool in accordance with the present invention.

The apparatus 10 can also include electrical isolation should the round cord 90 be electrified by a round saddle liner 53 and a round hook liner 66 (see FIGS. 2 and 3).

Figure 4:
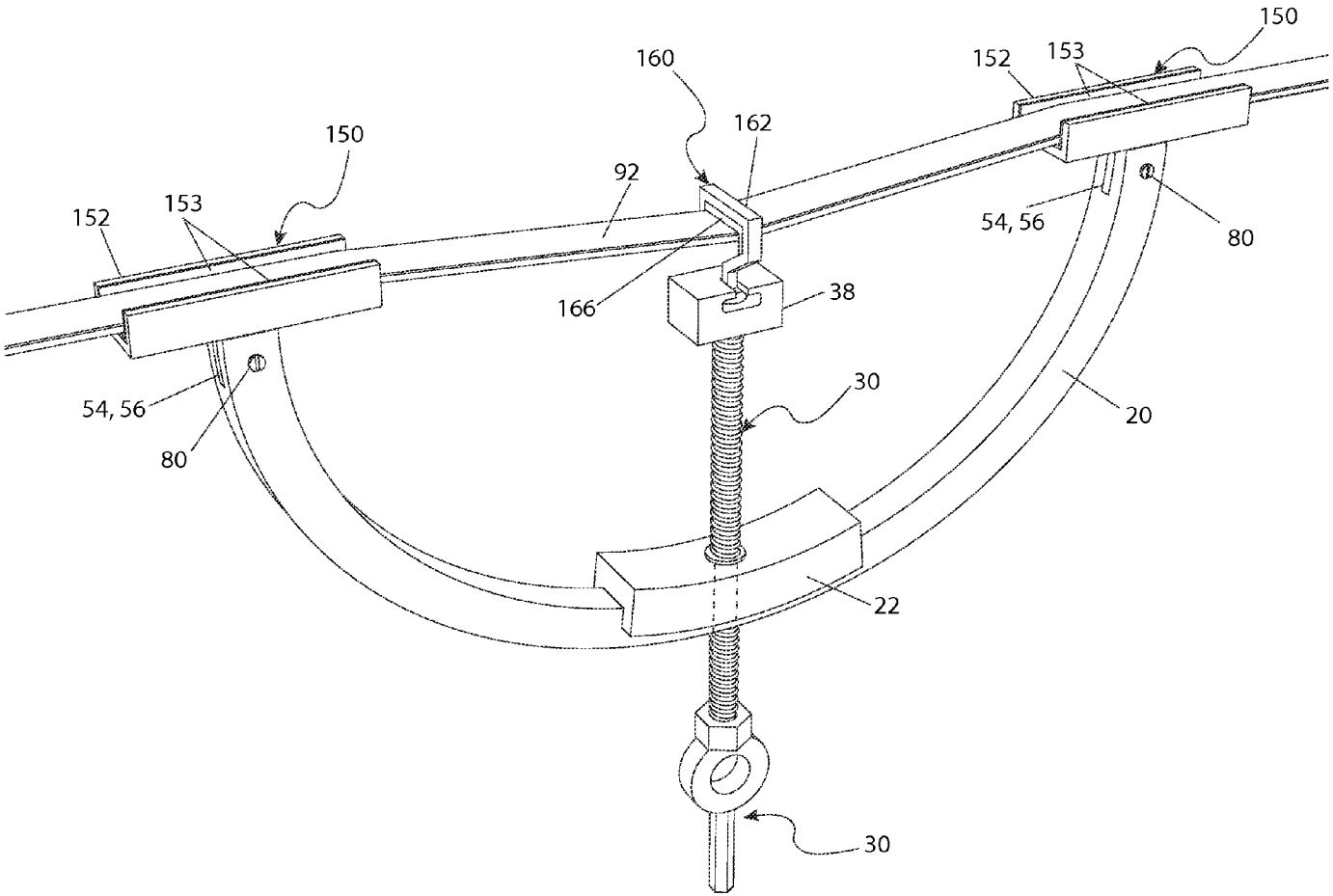

The round saddle assemblies 50 and the round hook assembly 60 are interchangeable to provide different shapes and configurations and allowing the frame 20 and drive shaft assembly 30 to be utilized with cable, wire, rope, flat straps, and the like; thus allowing the apparatus 10 to be used with guy lines, ropes, tie-downs, strapping, or similar cord structures (see FIG. 4).

Referring now to FIG. 2, the swivel mount 38 of the drive shaft assembly 30 can be freely rotatably attached to the round hook assembly 60 by a first slot 39 and a second slot 40. The round hook assembly 60 can include a round cord hook 62 having an integral disc-shaped base 64. The round hook assembly 60 is rotatably engaged within the first 39 and second 40 slots. The slots 39, 40 can be formed or machined into side and top surfaces of the swivel mount 38, respectively. The slots 39, 40 intersect with each other to form an entrapping inverted "T"-shaped opening. The "T"-shaped opening provides sliding insertion of the disc-shaped base 64 and upwardly protruding round cord hook 62 of the round hook assembly 60.

The round cord hook 62 can include a round hook liner 66 made of a non-conductive material such as rubber, being especially useful in cases where the round cord 90 performs an electrical function. The round hook liner 66 can preferably be affixed to the round cord hook 62 using industrial adhesives and covers an upper portion of the round cord hook 62 which may come in contact with the round cord 90, thereby providing electrical isolation capability.

Referring now to FIG. 3, each round saddle assembly 50 provides a contoured support to a length of the round cord 90. Each round saddle assembly 50 provides a unitary structure having a half-cylinder-shaped round saddle 52. The saddle assembly 50 can optionally include a round saddle liner 53 which covers an upper concave surface. The saddle assembly 50 can also include a rectangular frame mount 54 that protrudes downwardly from a bottom surface. The frame mount 54 can be inserted into a slot 56 located at the upper end 26 of the frame 20 and fastened using a threaded fastener 80, such as a bolt, which passes through respective fastener apertures 28 and is envisioned to be secured with a nut fastener 82. The frame mount 54 and slot 56 allow the round saddle assembly 50 to tilt as tension is applied to the round cord 90 (see FIG. 1).

The round saddle liner 53 provides round saddle 52 with similar electrical isolation capability as the aforementioned round hook liner 66.

Referring now to FIG. 4, another embodiment of the disclosed apparatus 100 can include a flat saddle assembly 150 and a flat hook assembly 160. The flat saddle assemblies 150 and a flat hook assembly 160 include rectangular profiles suitable to a strap-type flat cord 92. It can be appreciated by one skilled in the art that the disclosed apparatus 10 can be introduced having a plurality of available saddle assemblies and hook assemblies which enable utilization of the apparatus 10 with various sized and shaped cord types.

Each flat saddle assembly 150 can include a channel-shaped rectangular flat saddle 152 having a corresponding flat saddle liner 153, which covers the three (3) inner surfaces, to provide electrical isolation. Similarly shaped, the flat hook assembly 60 can include an inverted channel-shaped flat hook 162 having a corresponding flat hook liner 166. It is envisioned that a width dimension of the flat saddle 152 and flat hook 162 can be introduced in various sizes that match various types of corresponding flat cords 92. Furthermore, it is envisioned that additional saddles and hooks can be introduced having various different profile shapes including, but not limited to: "V"-shaped, roller-type, and the like, and as such should not be interpreted as a limiting factor of the disclosed apparatus 10.

It is envisioned that other styles and configurations of the disclosed apparatus 10 can be easily incorporated into the teachings of the present disclosure, and only certain configurations have been shown and described for purposes of clarity and disclosure and not by way of limitation of scope.

The present apparatus 10 can be utilized by the common user in a simple and effortless manner with little or no training. After initial purchase or acquisition of the apparatus 10, it can be installed as indicated in FIGS. 1 and 4.

The method of installing and utilizing one embodiment of the apparatus 10 may be achieved by performing the following steps: procuring a model of the apparatus 10 having round saddle assemblies 50 and round hook assembly 60 having a correct size and profile as the anticipated round cord 92 onto which the apparatus 10 is to be used; installing the round hook assembly 60 onto the swivel mount 38 by inserting the hook base 64 into the first 39 and second 40 slots of the swivel mount 38; raising the drive shaft assembly 30 by rotating the hex nut drive 34 using a wrench, or rotating the thumb screw feature 35 manually, or rotating the hex rod drive 36 using a drill or similar motorized tool, until the attached round hook assembly 60 is positioned above the round saddle assemblies 50; positioning the apparatus 10 such that the round cord 90 is nested within both round saddle assemblies 50 and beneath the round hook 60; lowering the round hook 60 by rotating the drive features 34, 35, 36 of the drive shaft assembly 30 until the round cord 90 is pulled downwardly by the round hook assembly 60 enough to remove a desired amount of slack; adjusting the apparatus 10 as needed to maintain a desired tension on the round cord 90; and, benefiting from a portable method to adjust a tension of a round cord 90 afforded a user of the present apparatus 10.

The method of installing and utilizing the apparatus 10 another embodiment 100 may be achieved in like manner as described above by performing the following additional steps: procuring flat saddle assemblies 150 and a flat hook assembly 160 having a particular size and profile which matches an anticipated flat cord 92 onto which the present apparatus 100 is to be used; removing the round saddle assemblies 50 and round hook assembly 60 from the frame 20, if previously installed; installing the flat saddle assemblies 150 and the flat hook assembly 160 onto respective frame upper ends 26 and swivel mount 38 as described above; and, adjusting and utilizing the flat apparatus 100 in a similar manner as the previously described embodiment.

The foregoing embodiments of the disclosed cord tightening tool have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A cord tightening tool comprising:

a frame comprising opposing ends;

a pair of saddles pivotably attached to said opposing ends; and, a hook assembly comprising:

a drive shaft adjustably attached to said frame halfway between said opposing ends, said drive shaft comprising a lower end and a longitudinally opposed upper end; and a hook rotatably attached to said upper end of said drive shaft.

2. The tool of claim 1, wherein said frame further comprises a generally semi-circular shape.

3. The tool of claim 1, wherein each saddle of said pair of saddles comprises an elongated body, wherein the elongated body is pivotably attached about a midpoint to said end of said frame.

4. The tool of claim 3, wherein said elongated body comprises a generally semi-cylindrical cross-sectional shape configured to receive a round cord material.

5. The tool of claim 3, wherein said elongated body comprises a generally semi-rectangular cross-sectional shape configured to receive a flat cord material.

6. The tool of claim 1, wherein each of said pair of saddles comprises an electrically insulative saddle liner.

7. The tool of claim 1, wherein said hook assembly comprises:

a swivel mount rigidly connected to said upper end of said drive shaft, said swivel mount comprising a slot, wherein said hook is received by said slot and is freely rotatable with respect to said swivel mount.

8. The tool of claim 1, wherein said drive shaft comprises external threading.

9. The tool of claim 8, wherein said frame further comprises a drive block having an internally threaded insert configured to threadably receive said drive shaft.

10. The tool of claim 1, wherein said hook comprises a round hook configured to capture a round cord material.

11. The tool of claim 1, wherein said hook comprises a rectangular hook configured to capture a flat cord material.

12. The tool of claim 1, wherein said hook comprises an electrically insulative hook liner.

13. The tool of claim 1, wherein said drive shaft further comprises a hex nut drive proximate said lower end.

14. The tool of claim 1, wherein said drive shaft further comprises a thumbscrew feature proximate said lower end.

15. The tool of claim 1, wherein said drive shaft further comprises a hex rod drive proximate said lower end.

16. A cord tightening tool comprising:

a curved frame comprising a first end and a laterally opposed second end;

a first saddle pivotably attached to said first end of said frame;

a second saddle pivotably attached to said second end of said frame;

a drive shaft adjustably attached to said frame between said first end and said second end, said drive shaft comprising a lower end and an upper end;

a swivel mount rigidly attached to said upper end of said drive shaft, said swivel mount comprising a slot disposed at least partially therethrough, said slot comprising an inverted T-shape; and, a hook assembly rotatably attached to said swivel mount, said hook assembly comprising a base and a hook extending from said base, said base being received within said slot such that said hook is freely rotatable with respect to said drive shaft.

17. The tool of claim 16, wherein said first saddle is removably attached to said first end of said frame and said second saddles is removably attached to said second end of said frame.

18. The tool of claim 16, wherein said frame further comprises a drive block having an internally threaded insert; and, wherein said drive shaft comprises external threading configured to threadably attach said drive shaft to said threaded insert.

19. The tool of claim 16, wherein said drive shaft further comprises:

a hex rod drive proximate said lower end;

a thumbscrew feature proximate said hex rod drive; and, a hex nut drive proximate said thumbscrew feature.

20. The tool of claim 16, wherein said hook is detachable from said swivel mount.

* * * * *